US009549643B2

(12) United States Patent
Hayes et al.

(10) Patent No.: US 9,549,643 B2
(45) Date of Patent: Jan. 24, 2017

(54) ADJUSTABLE CURVED DOOR ASSEMBLY

(71) Applicant: Delta Faucet Corporation, Indianapolis, IN (US)

(72) Inventors: Gerald Hayes, Lebanon, IN (US); Jeff Ferris, Carmel, IN (US)

(73) Assignee: Delta Faucet Company, Indianapolis, IN (US)

( * ) Notice: Subject to any disclaimer, the term of this patent is extended or adjusted under 35 U.S.C. 154(b) by 29 days.

(21) Appl. No.: 14/674,648

(22) Filed: Mar. 31, 2015

(65) Prior Publication Data

US 2016/0287027 A1 Oct. 6, 2016

(51) Int. Cl.

| | |
|---|---|
| ***A47K 3/34*** | (2006.01) |
| ***E06B 3/90*** | (2006.01) |
| ***E05D 15/02*** | (2006.01) |
| ***E05D 15/06*** | (2006.01) |

(52) U.S. Cl.

CPC ..... *A47K 3/34* (2013.01); *E05D 15/02* (2013.01); *E05D 15/0621* (2013.01); *E05D 15/0643* (2013.01); *E05D 15/0652* (2013.01); *E06B 3/903* (2013.01)

(58) Field of Classification Search

CPC .. E06B 3/7007; E05D 15/0626; E05D 15/063; E05D 15/0652; A47K 3/34; Y10T 16/379

USPC ..... 49/4, 409, 410, 411; 4/607, 608, 610

See application file for complete search history.

(56) References Cited

U.S. PATENT DOCUMENTS

| | | | | | |
|---|---|---|---|---|---|
| 1,225,098 | A * | 5/1917 | Addison | E05D 15/063 | 16/87 R |
| 2,297,327 | A * | 9/1942 | Riley | A47H 1/124 | 248/263 |
| 2,778,030 | A * | 1/1957 | Goche | A47K 3/38 | 16/87.4 R |
| 2,893,069 | A * | 7/1959 | Kessler | A47K 3/34 | 16/94 R |
| 3,342,246 | A * | 9/1967 | Reiss | B63B 19/19 | 16/96 R |
| 4,084,289 | A * | 4/1978 | Naimo | E05D 15/0652 | 16/87 R |
| 4,282,631 | A * | 8/1981 | Uehara | E05D 15/0665 | 16/102 |
| 4,807,312 | A * | 2/1989 | Baus | A47K 3/34 | 160/195 |
| 4,882,795 | A * | 11/1989 | Baus | A47K 3/34 | 160/201 |
| 4,956,942 | A * | 9/1990 | Lisak | B60J 1/17 | 49/212 |
| 4,974,269 | A * | 12/1990 | Baus | A47K 3/362 | 4/613 |

(Continued)

*Primary Examiner* — Brian Mattei
*Assistant Examiner* — Catherine A Kelly
(74) *Attorney, Agent, or Firm* — Faegre Baker Daniels, LLP

(57) ABSTRACT

A door assembly compensates for any deflection of the track which may occur with a heavy door material and/or a curved door support track. In particular, the present disclosure provides track mounting assemblies which can be tilted in order to "fine tune" the orientation of the door with respect to the surrounding support structure, e.g., the bathtub or shower base threshold. If the curved track deflects from the weight of one or more sliding doors, the track can be tilted to ensure that the door remains level and functions as intended.

17 Claims, 5 Drawing Sheets

(56) References Cited

U.S. PATENT DOCUMENTS

| | | | | | |
|---|---|---|---|---|---|
| 5,430,976 | A * | 7/1995 | Wirsing | E05F 11/382 | 49/452 |
| 5,575,022 | A * | 11/1996 | Duffy | A47K 3/34 | 4/557 |
| 5,893,181 | A * | 4/1999 | Moncaster | A47K 3/362 | 160/211 |
| 6,427,286 | B1 * | 8/2002 | Erskine | B63B 43/26 | 16/90 |
| 7,065,831 | B2 * | 6/2006 | Elmer | E05D 15/0652 | 16/106 |
| 7,346,939 | B2 * | 3/2008 | Perry | A47K 3/34 | 4/557 |
| 7,735,262 | B2 * | 6/2010 | Peterson | E06B 3/4654 | 49/372 |
| 7,921,512 | B2 * | 4/2011 | Michel | B64D 11/0023 | 16/102 |
| 7,926,127 | B2 * | 4/2011 | Barrese | A47K 3/38 | 4/610 |
| 8,069,507 | B2 * | 12/2011 | Didehvar | A47K 3/38 | 4/610 |
| 9,033,163 | B2 * | 5/2015 | Hsu | A47H 1/122 | 211/105.3 |
| 2015/0000196 | A1 * | 1/2015 | Yuhas | A47K 3/34 | 49/41 |

* cited by examiner

ADJUSTABLE CURVED DOOR ASSEMBLY

BACKGROUND

1. Technical Field

The present disclosure relates to curved slideable doors and, in particular, to adjustable curved shower doors.

2. Description of the Related Art

Bathing enclosures are used to retain water from, e.g., a showerhead within an enclosed area. Recently, bathing enclosures utilize curved outer walls in order to create additional space within the enclosure. The outer walls may be a shower curtain on a curved rod, for example, or a curved door on a correspondingly curved slider track.

A favored material for curved doors used in bathroom enclosures is glass, which admits light to the enclosure, is waterproof and can be easily cleaned. In order to support the weight of the glass doors, the curved tracks along which the doors slide may be made from a robust, bulky material. In some cases, curved tracks may deflect when the weight of the glass door assembly is placed on a track, resulting in a "dip" or depression at the middle of the track together with rotation of the track due to the moment created by the curve. Misalignment of the tracks may also cause or exacerbate such a "dip." This deflection and/or rotation may urge the door or doors toward the middle of the enclosure, causing the door or doors to open unintentionally.

Curved-door designs may have a moveable door panel which slides between open and closed positions, and a stationary door panel which is rigidly fixed to the surrounding support structures and may itself be used as a support for mounting the sliding door.

SUMMARY

The present disclosure provides a door assembly which compensates for any deflection of the track which may occur with a heavy door material and/or a curved door support track. In particular, the present disclosure provides track mounting assemblies which can be tilted in order to "fine tune" the orientation of the door with respect to the surrounding support structure, e.g., the bathtub or shower base threshold. If the curved track deflects from the weight of one or more sliding doors, the track can be tilted to ensure that the door remains level and functions as intended.

In one form thereof, the present disclosure provides a sliding door assembly comprising: a door; a support track slideably supporting the door, the support track having axial ends with a longitudinal extent therebetween, and a cross-sectional shape perpendicular to the longitudinal extent, the cross-sectional shape defining a first pivot area and an adjuster engagement area spaced from the first pivot area; and a track mounting assembly fixable to an adjacent support surface, the track mounting assembly comprising: a support body including a track slot sized to receive the support track, the track slot defining a second pivot area adapted to pivotably engage with the first pivot area; and a tilt adjuster engaging the adjuster engagement area of the support track to selectively adjust a tilt of the support track within the track slot.

In another form thereof, the present disclosure a sliding door adjustment mechanism comprising: a support body having a tapered track slot including a narrow portion defining a pivot area and a wide portion defining an adjuster area, the tapered track slot sized to pivotably receive a support track of a sliding door; and a support anchor coupled to the support body and adapted to be fixed to an adjacent support surface.

In yet another form thereof, the present disclosure provides a method for adjusting a tilt angle of a sliding door, the method comprising: affixing axial ends of a support track to a pair of mutually opposed support surfaces; slideably attaching a door to the support track such that the support track supports the weight of the door, and the support track experiences a downward deflection; tilting at least one of the axial ends of the support track to correct the downward deflection.

BRIEF DESCRIPTION OF THE DRAWINGS

The above-mentioned and other features of the disclosure, and the manner of attaining them, will become more apparent and will be better understood by reference to the following description of embodiments of the disclosure taken in conjunction with the accompanying drawings, wherein.

Corresponding reference characters indicate corresponding parts throughout the several views. The exemplifications set out herein illustrate embodiments of the disclosure and such exemplifications are not to be construed as limiting the scope of the invention in any manner.

DETAILED DESCRIPTION

The present disclosure provides a curved and sliding door assembly 10 (FIG. 1) for bathing enclosures. Assembly 10 includes support tracks 16 which slidably support first and second curved doors 12, 14 and can be tilted away from a centered, vertical position to a deflection-correction orientation in order to provide for onsite adjustment of the tilt angle of support tracks 16. This adjustable tilt can be used to selectively correct for a downward deflection of support tracks 16 due to the weight of doors 12 and/or 14. The tilting of tracks 16 is effected by adjustment of track mounting assemblies 30 disposed at one or both ends of support tracks 16. In an exemplary embodiment and as further described below, mounting assemblies 30 provide for user-manipulable fine adjustment of the tilt angle of support tracks 16, such that an appropriate corrective tilt angle can be selected as needed for each individual installation of sliding door assembly 10.

Figure 1:
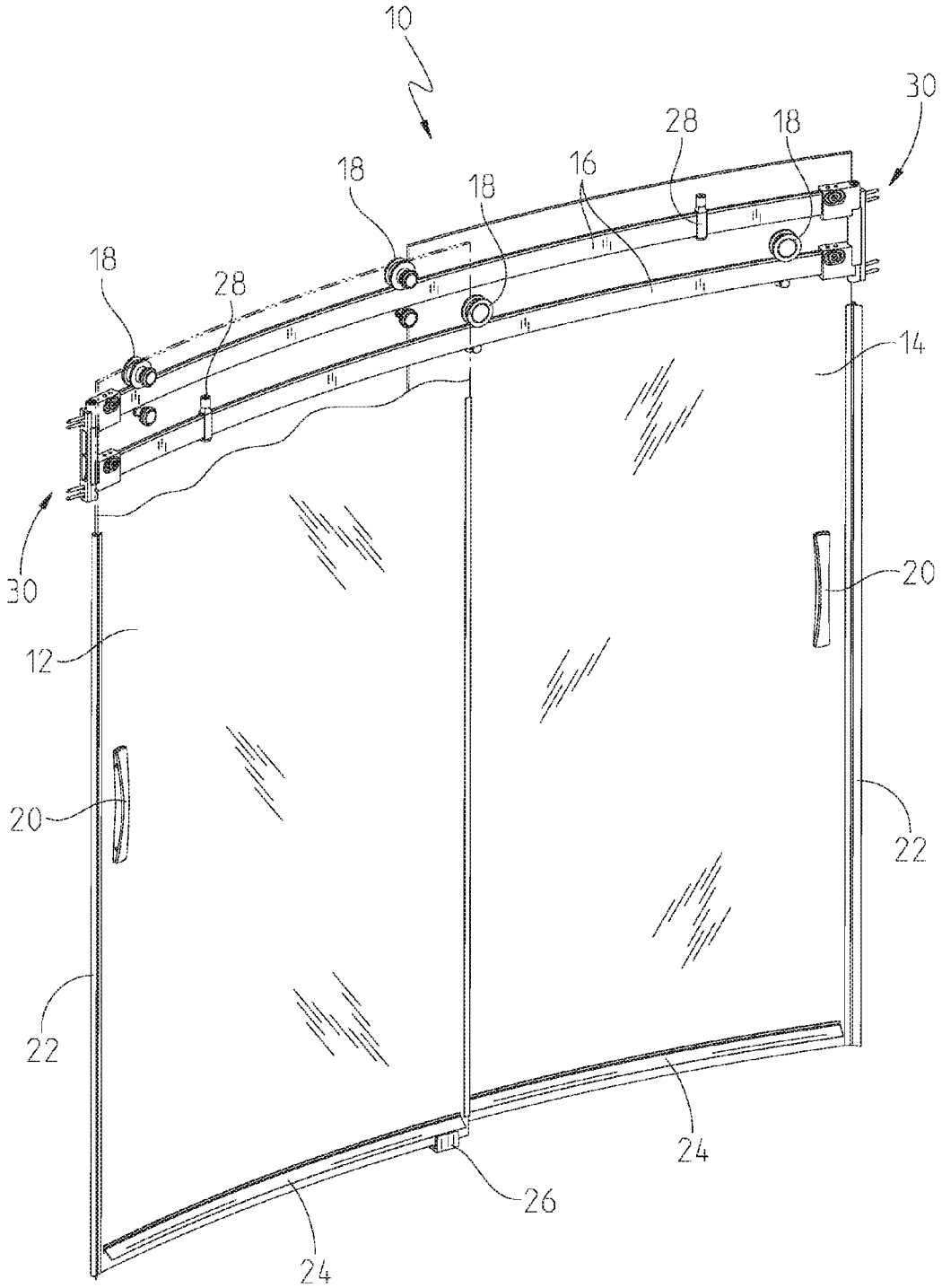
FIG. 1 is a perspective view of a curved door assembly made in accordance with the present disclosure.

Turning to FIG. 1, sliding door assembly 10 includes a first curved sliding door 12 supported by an upper support track 16 and a second curved sliding door 14 supported by a lower support track 16. In the illustrated embodiment, first and second doors 12, 14 are laterally offset with respect to one another such that each of the doors 12, 14 is slidable from a closed configuration, as shown in FIG. 1, to an open configuration by pushing a respective handle 20 away from the adjacent wall of the bathing enclosure (not shown).

In particular, each of doors 12, 14 is slideably supported by a pair of roller assemblies 18 affixed to the respective door panel. Roller assemblies 18 each engage a respective support track 16 as illustrated, and provide a secure and low-friction interface between doors 12, 14 and their respective support tracks 16. In an exemplary embodiment shown in FIG. 2, roller assembly 18 includes weight bearing roller 36 rotatably mounted to an axle, which is in turn fixed to the panel of door 14. Weight bearing roller 36 is rollingly received on the upper surface of the adjacent support track 16. Roller assembly 18 also includes retainer roller 38 which is rollingly received on a lower surface of support track 16, and operates to "capture" or slideably fix door 14 upon support track 16. Roller arm 40 couples weight bearing roller 36 to retainer roller 38.

In the illustrative embodiment of FIG. 1, doors 12, 14 have a convex outer surface and a correspondingly concave inner surface. Support tracks 16 may be similarly curved and disposed along the concave inner surfaces of doors 12, 14, such that the outer surfaces (visible from the room in which the bathing enclosure is located) present a clean and uncluttered appearance.

Doors 12, 14 include side gaskets 22 and bottom gaskets 24 which provide a waterproof seal between the outside and lower edges, respectively, of doors 12, 14 and the adjacent support surfaces of the bathing enclosure. For example, side gasket 22 may interface with a vertical wall of the bathing enclosure to provide a fluid-tight seal between the interior and exterior of the bathing enclosure along the vertical wall, while bottom gaskets 24 similarly provide a fluid tight seal between the lower edges of doors 12, 14 and the adjacent floor, threshold or tub wall of the bathing enclosure. Door guide 26 may be provided along the lower door surfaces to restrain lateral movement of doors 12, 14 as they are moved between the open and closed positions as described above.

Figure 2:
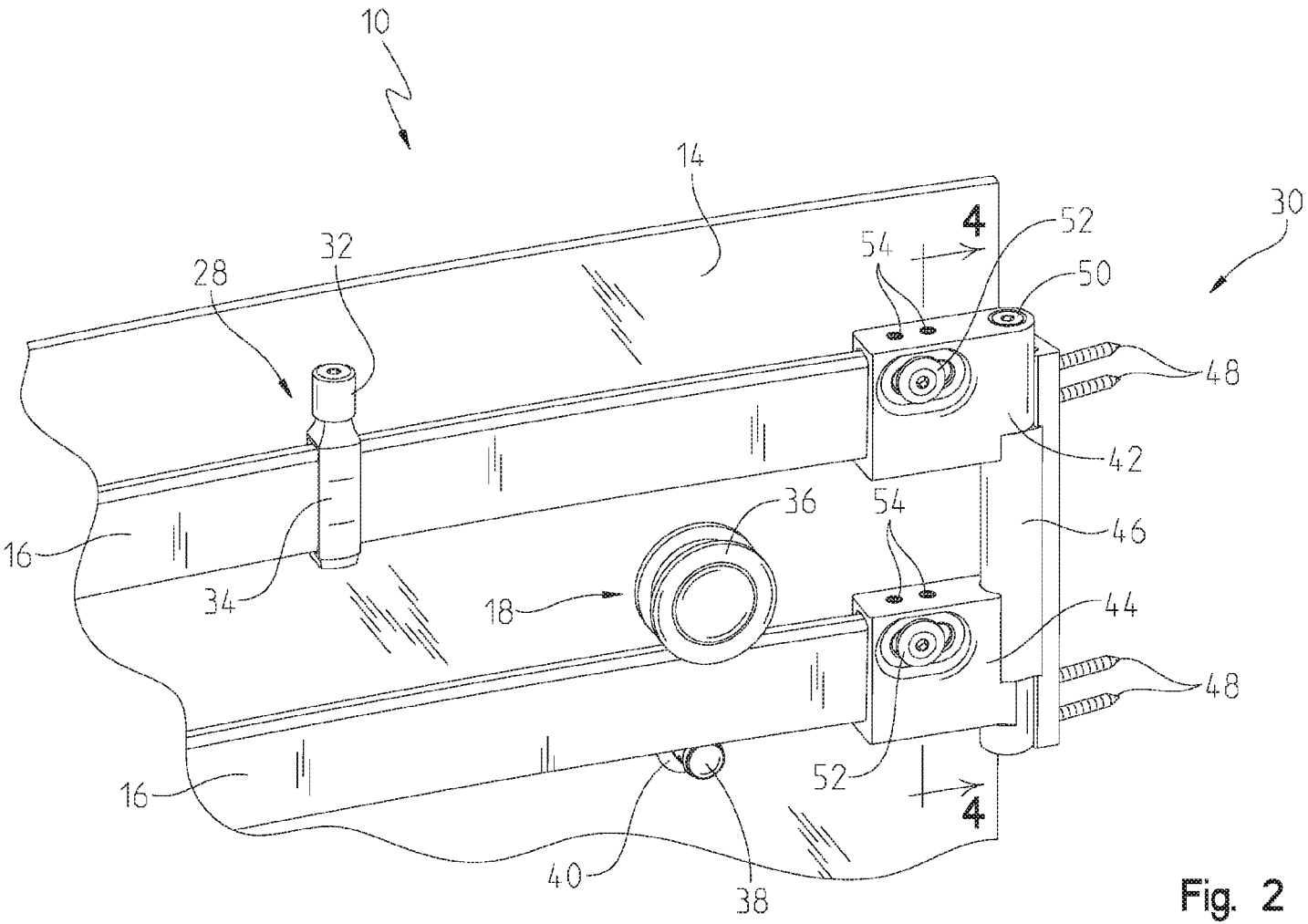
FIG. 2 is an enlarged, partial perspective view of the door assembly shown in FIG. 1, illustrating a support track mounting assembly.

Door stops 28 may be mounted on each of support tracks 16 in order to limit the slidable motion range of each door 12, 14 along the longitudinal extent of the support track 16 to which the door is mounted. Referring to FIG. 2, each door stop 28 includes retainer 34 sized to mount to a respective support track 16, and a bumper 32 extending upwardly from retainer 34 and positioned to engage one of rollers 36 when the respective door 12 or 14 reaches a fully open configuration. As shown in FIG. 1, door stops 28 are positioned to allow each of doors 12, 14 to be slidably opened a substantial distance such that roller assemblies 18 are allowed to traverse most of the longitudinal extent of the support track 16. The distance from the axial end of support track 16 to the door stop 28 may be set by an installer according to the particular spatial arrangement of the bathing enclosure to which sliding door assembly 10 is applied.

Figure 3:
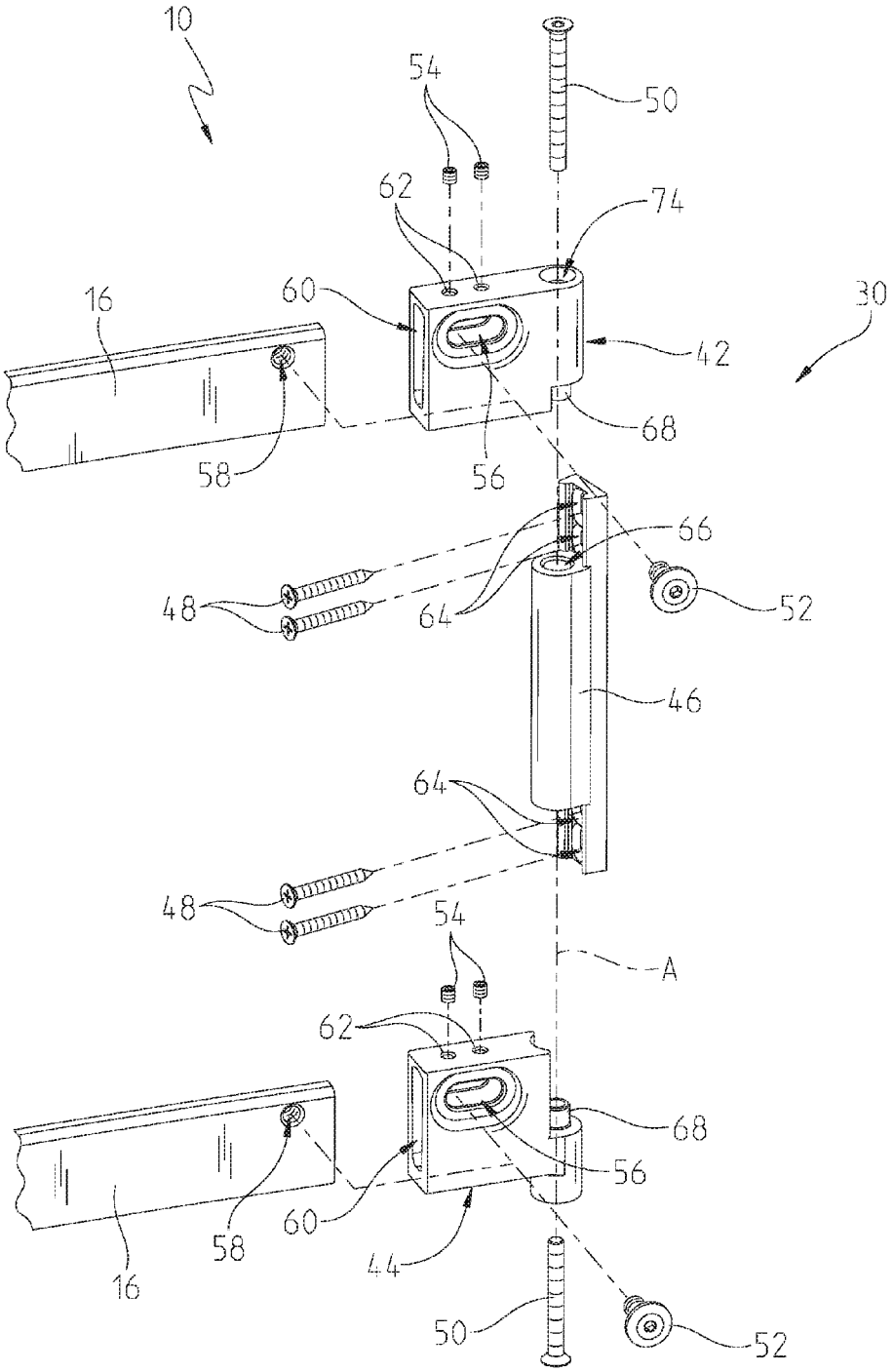
FIG. 3 is an exploded, perspective view of the support track mounting assembly shown in FIG. 2.

Support tracks 16 mount to the walls of the bathing enclosure via track mounting assemblies 30, as shown in FIG. 1. FIG. 2 provides a detailed illustration of the connection between support tracks 16 and tracking mounting assembly 30 at an axial end of each support track 16. In the illustrated embodiment of FIG. 1, the opposite axial ends of support tracks 16 are coupled to a track mounting assembly 30 in the same manner as illustrated in FIG. 2. Track mounting assembly 30 includes upper support body 42 which receives the upper support track 16, and lower support body 44 which receives the lower support track 16, and support anchor 46. As illustrated in FIG. 3, support anchor 46 is a generally elongate component defining a generally vertical longitudinal axis A. Support anchor 46 has support bodies 42, 44 coupled to its opposite ends as shown in FIG. 2, such that longitudinal axis A is also the pivot axis about which upper and lower support bodies 42, 44 rotate (FIG. 3).

Support anchor 46 is coupled to each of the upper and lower support bodies 42, 44, and provides a fixed mounting point for affixing support bodies 42, 44, and therefore support tracks 16 the other associated structures of sliding door assembly 10, relative to the adjacent support surfaces. In particular, as shown in FIG. 3, support anchor 46 includes fastener apertures 64 sized to receive fasteners 48 therethrough. Upon assembly, support anchor 46 may be affixed to the adjacent support surface by driving fasteners 48 into the support surface, followed by assembly of the remaining components of track mounting assembly 30.

Upper support body 42 is rotatably coupled to anchor 46 by lowering boss 68 into support mounting aperture 66. Pivot pin 50 may then be passed through pivot pin aperture 74 and threadably engaged with support mounting aperture 66 to affix upper support body 42 with respect to support anchor 46. When pivot pin 50 is loose, upper support body 42 may pivot with respect to anchor 46, such that the curved support track 16 may approach the support surface at a non-perpendicular orientation. This configuration facilitates the use of the curved support tracks 16 (and the correspondingly curved first and second doors 12, 14) between parallel walls commonly found in bathing enclosures. Moreover, the pivotability of upper support body 42 with respect to anchor 46 ensures that an installer of sliding door assembly 10 can align support tracks 16 with track slot 60 (as further described below), regardless of whether slot 60 is perpendicular with the adjacent support surface. When support body 42 is pivoted to its desired orientation (e.g., when slot 60 received and is aligned with an axial end of support track 16), pivot pin 50 may be tightened to secure support body 42 to anchor 46 and, therefore, to the adjacent support surface.

Lower support body 44 is also pivotably mounted to support anchor 46 by pivot pin 50 (FIG. 3), in the same manner as upper support body 42. However, the spatial arrangement of the track slots 60 relative to axis A varies between upper and lower support bodies 42 and 44, in order to laterally offset the two slots 60 are with respect to one another. That is, the plane defined by slot 60 in lower body 44 is not coplanar with the plane defined by slot 60 in upper body, even if upper and lower bodies 42, 44 are pivoted parallel to one another as shown in FIG. 3. This lateral offset accommodates the corresponding lateral offset between the upper and lower support tracks 16, as described above, which in turn accommodates the lateral offset of first and second doors 12 and 14.

Figure 4:
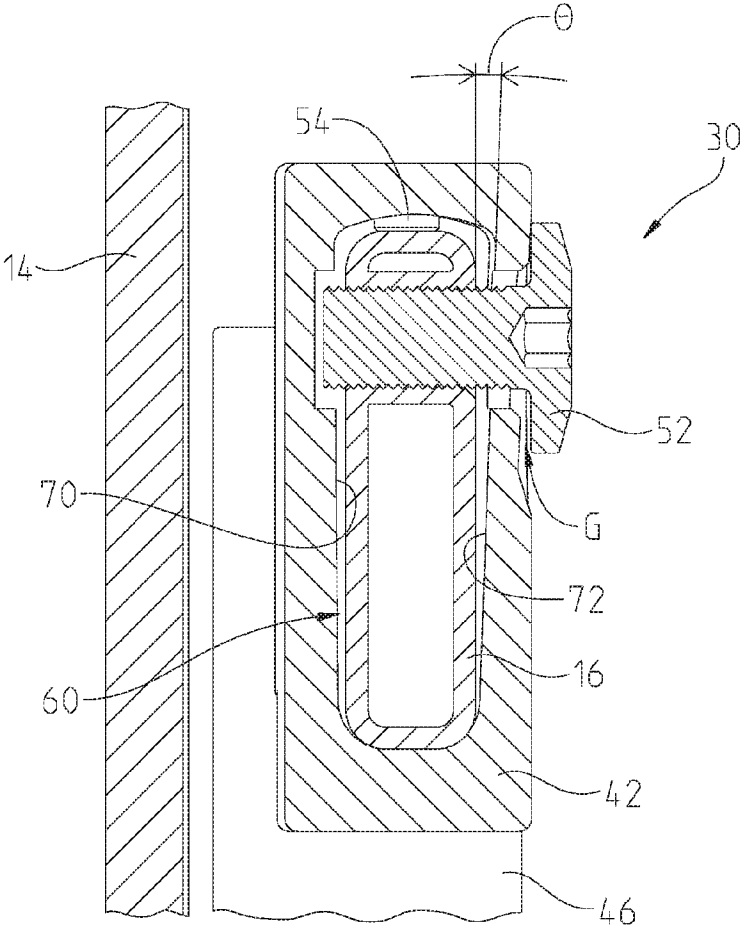
FIG. 4 is a cross-section view of the support track mounting assembly shown in FIG. 2, taken along the line 4-4, in which the support rod is in a centered vertical orientation.

In addition to the pivotable adjustment of upper and lower support bodies 42 and 44, support tracks 16 have an adjustable "tilt" when received within track slots 60, as noted above and shown in FIG. 3. In the illustrated embodiment, support bodies 42, 44 each include adjuster aperture 56, which is a slotted aperture allowing for passage of flange bolt 52 therethrough at a variety of positions along the longitudinal extent of slot 60. When an axial end of support track 16 is received within track slot 60, threaded aperture 58 formed in track 16 aligns with adjuster aperture 56, such that a threaded portion of flange bolt 52 may be threadably engaged with aperture 58, as shown in FIG. 4. At this point, support track 16 is affixed with respect to the adjacent support surface via one of support bodies 42, 44 and support anchor 46. Further adjustment of flange bolt 52 operates to change the tilt of support track 16, as further described below.

FIG. 4 illustrates the cross-sectional shape and configuration of support track 16 and support body 42, as taken in a cross-section perpendicular to the longitudinal axes of support track 16 and track slot 60, it being understood that these two longitudinal axes are substantially aligned when track 16 is received in slot 60. For purposes of clarity, upper support body 42 only is shown in FIG. 4, though the same cross-sectional configuration may be used for lower support body 44 and the lower support track 16.

Track slot 60 defines a tapered cross-sectional profile, including a substantially vertical first inner wall 70 and an angled second inner wall 72 defining taper angle Θ, which is equal to the overall taper angle of slot 60. Slot 60 is narrower at its bottom portion and becomes wider with progression toward the top portion, i.e., toward flange bolt 52. In the configuration of FIG. 4, support track 16 is in a centered vertical orientation within slot 60, such that the vertical walls of support track 16 are substantially parallel to the vertical first inner wall 70 and define angle Θ with respect to angled wall 72. In this configuration, the longitudinal axis of flange bolt 52 is substantially horizontal and gap G is formed between a lower portion of the flange of bolt 52 and the adjacent surface of upper support body 42 as illustrated. The configuration of FIG. 4 will typically result in a generally level curved support track 16, provided the axial ends of track 16 are at equal heights and track 16 is not deflected downwardly. On the other hand, downward deflection of track 16 may cause a "dip" in the center portion of track 16 which can be corrected by tilting track 16 at track mounting assembly 30, as discussed further below.

When first door 12 is installed upon the upper support track 16, weight bearing rollers 36 are rollingly received upon an upper surface of support track 16, as illustrated in FIG. 1 and described above. At this point, all or nearly all of the weight of door 12 is supported by support track 16. Particularly in the case of curved door 12 and the associated curved support track 16, this weight may create a moment which urges downward deflection and rotation of support track 16 to create the aforementioned "dip" near the center of support track 16. For purposes of the present disclosure, references to "deflection" in the context of curved tracks 16 may encompass both downward deflection and rotation, it being understood that both can be expected to occur under the weight of doors 12 and/or 14. This dip may in turn urge doors 12 to roll "downhill" toward the middle of the longitudinal extent of track 16, such that door 12 is urged toward an open position. Moreover, depending on the size, material, and configuration of door 12, the amount of such deflection and the corresponding depth of the central dip in track 16 may vary among various individual installations of sliding door assembly 10.

In order to selectively correct for such deflection of track 16, track mounting assembly 30 may be used to "tilt" support track 16 through a continuously adjustable range of potential tilt angles. The chosen level of tilt is that which corrects for the particular deflection encountered in an installation of sliding door assembly 10, such that an installer may selectively tilt support track 16 into a desired orientation which eliminates any central "dip" and facilitates the desired operation during the opening and closing of door 12. The same correction may be applied to the lower track 16 and door 14, as appropriate. Moreover, although the moment created by the use of curved support tracks and curved doors 12, 14 inherently contributes to the creation of this central dip, it is contemplated that the present system of tilt adjustment may also be applied to non-curved enclosures, e.g., those including substantially planar doors and substantially linear support tracks, in order to correct for any deflection which may occur in that context.

Figure 5:
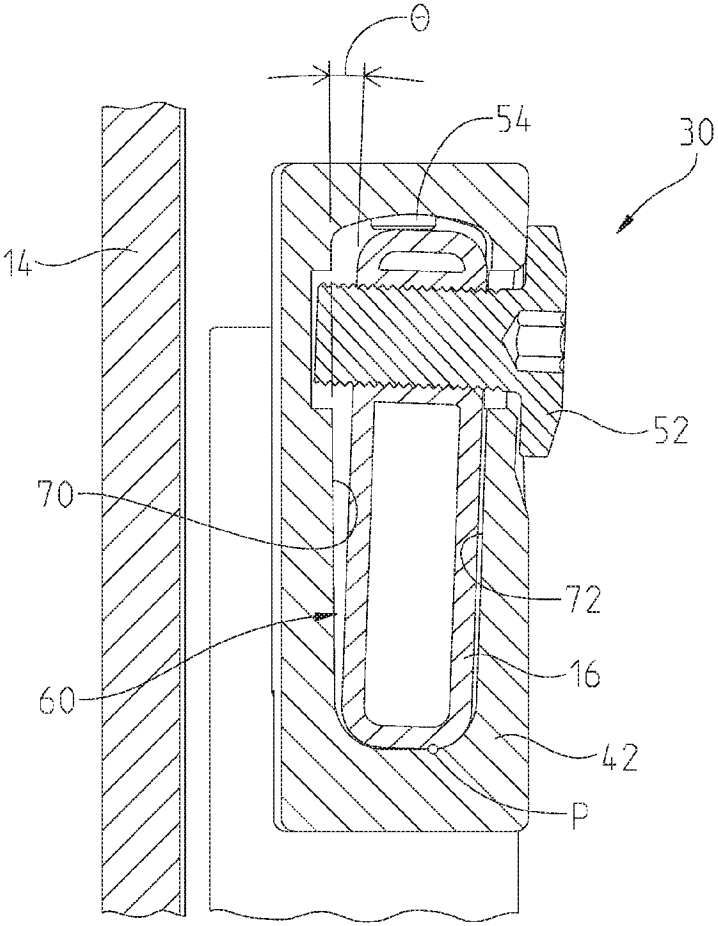
FIG. 5 is another cross-section view of the support track mounting assembly shown in FIG. 2, taken along the line 4-4, in which the support track is in a deflection-correction orientation.

FIG. 5 illustrates a cross-section of track mounting assembly 30 similar to that of FIG. 4, except that support track 16 is in a fully tilted orientation. Support track 16 includes an upper portion which forms an adjuster engagement area which is allowed to move within the wide upper portion of tapered slot 60, and a lower portion which forms a pivot area which is captured in the narrow lower portion of slot 60. The upper portion includes the threaded engagement between flange bolt 52 and threaded aperture 58 (FIG. 3), which can be used to selectively tilt the upper portion within slot 60, while the lower portion defines pivot area P about which support track 16 pivots as it tilts.

To achieve the tilted orientation of FIG. 5, the tilt adjuster (i.e., by rotating flange bolt 52) is tightened to draws only the upper portion of support track 16 toward the flange head of bolt 52. As a result, the upper portion of support track 16 laterally displaces in the wide portion of the tapered slot 60 while the lower portion of support track 16 pivots about pivot area P in the narrow lower portion of support track 16 of slot 60. When reconfigured to the fully tilted configuration as shown in FIG. 5, the formerly vertical walls of support track 16 become substantially parallel to the angled second inner wall 72, such that walls of support track 16 form angle Θ with respect to the vertical inner wall 70 of slot 60. Meanwhile, gap G (FIG. 4) substantially closes as the longitudinal axis of flange bolt 52 tilts along with support track 16.

Thus, the axial end of support track 16 is tilted within slot 60 such that the outer surface of track 16 faces upwardly as shown in FIG. 5. This upward tilt also tilts the rest of the longitudinal extent of track 16, including its center portion. If the center portion had a central dip or low point as noted above, this upward tilting may render the center portion substantially level.

Moreover, the amount of tilt imparted to support track 16 may be finally adjusted by rotating flange bolt 52 to achieve any desired tilt within the tilt range allowed by the taper of slot 60. In an exemplary embodiment, the maximum tilt angle Θ is about 2 degrees, though it is appreciated that other tilt angle ranges may be provided as required or desired for a particular application. In some applications, the maximum available tilt angle Θ may be varied by increasing or decreasing the amount of taper within slot 60, and may be set as low as 0.5 degrees, 1 degree, or 1.5 degrees, and may be as large as 2.5 degrees, 3 degrees, or 3.5 degrees, or may be any tilt angle within any range defined by any of the range of the foregoing values. In one exemplary embodiment using tracks 16 with an outward curvature defining a radius of 106 inches, for example, a tilt angle Θ of 2 degrees may result in a ⅛-inch corrective elevation change at the middle of the longitudinal extent of support track 16. That is, if the lower portion of track 16 is ⅛-inch lower than the axial ends of track 16 due to weight-induced deflection, a 2-degree upward tilt of track 16 will result in the center portion becoming level with the axial ends. Similar correlations may be inferred for other tilt angles, though it is appreciated that such correlations will vary for varying materials, geometries and sizes used in sliding door assembly 10. For example, the "dip" to be corrected can be expected to increase as the curve radius of curved tracks 16 decreases (i.e., as the tracks become "more curved"), and can be expected to decrease as the curve radius of curved tracks 16 increases. For an completely straight support track (i.e., one having an infinite radius), the dip is essentially zero.

When a desired tilt of support track 16 has been achieved, one or more set screws 54 (e.g., two set screws 54 as illustrated in FIGS. 2 and 3) may be used to affix support track 16 at the desired tilt angle. In the illustrated embodiment, set screws 54 are received in limiter apertures 62 (FIG. 3) and can be rotated to axially advance set screws 54 into and out of track slot 60. Limiter apertures 62 are formed in the top surfaces of upper support body 42 and lower support body 44, respectively, such that set screws 54 engage the tiltable upper portion of support track 16 within the wide upper portion of tapered slot 60. When it is desired to affix support track 16 at its present tilt angle, set screws 54 are rotated to axially protrude into track slot 60 until their distal ends engage the upper surface of support track 16, at which point set screws 54 act as to limit any further adjustment of the tilt of track 16.

Although flange bolt 52 and threaded aperture 58 are used for tilt adjustment in the illustrated embodiment, it is contemplated that other mechanisms may be used in alternative embodiments to achieve a similar tilt adjustment functionality. Examples of such alternative mechanisms include worm gears, wedges received between support track 16 and one of inner slot walls 70, 72, and the like. Yet another alternative is a ball joint or U-joint connection between tracks 16 and the adjacent support surface (e.g., via modified support bodies 42, 44) which is lockable in a desired configuration.

Figure 6:
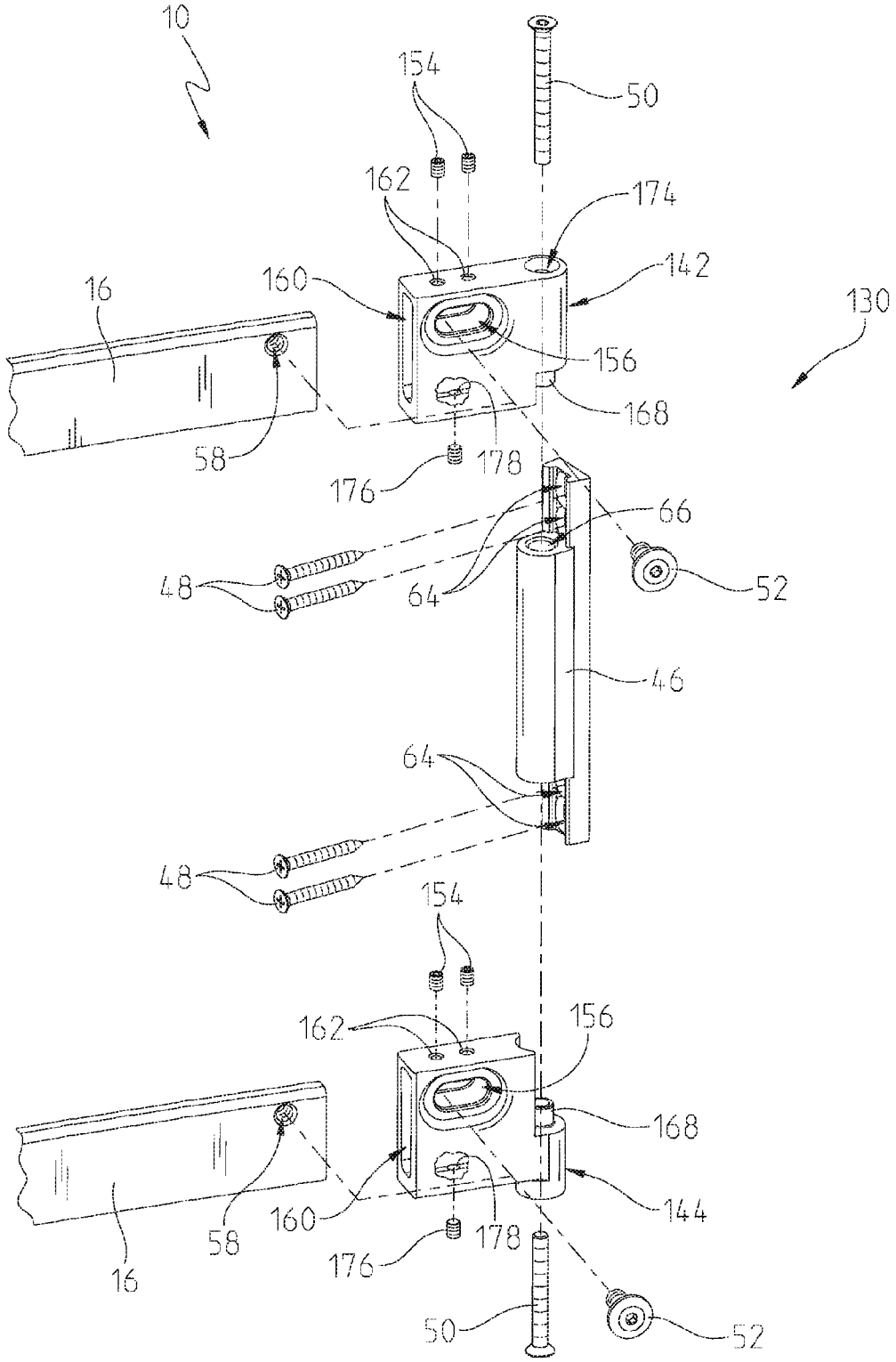
FIG. 6 is a perspective view of an alternative support track mounting assembly in accordance with the present disclosure, in which the support track is vertically adjustable with respect to the track mounting assembly.

Turning now to FIG. 6, an alternative support track mounting assembly 130 is illustrated in conjunction with support track 16. The structures shown in FIG. 6 are similar to the structures of sliding door assembly 10 described in detail above, and the structures shown in FIG. 6 have corresponding reference numbers to the structures of FIGS. 1-5, except with 100 added thereto. Moreover, the support track mounting assembly 130 shown in FIG. 6 may be used interchangeably with the other structures of sliding door assembly 10, and the same functions and features of assembly 30 may be present in assembly 130.

However, support track assembly 130 allows for vertical adjustment of the axial end of support track 16, such that the elevation of one or both of the ends of support track 16 can be adjusted to ensure that the overall track 16 is level upon installation. In the illustrated embodiment, slot 160 has been vertically expanded relative to slot 60, such that track 16 is vertically moveable within slot 160 through a limited range while still remaining captured by support body 142. Vertical adjustment of track 16 is effected by adjustment of adjuster screw 176, which is threadably engaged in threaded aperture 178 formed in the lower surface of body 142. Rotation of screw 176 causes screw 176 to protrude upwardly into slot 160, engaging a lower surface of track 16 and raising track 16 within slot 160.

In order to accommodate the tilt adjustment functionality of flange bolt 52 while maintaining alignment between bolt 52 and threaded aperture 58, adjuster aperture 156 is vertically enlarged as compared to adjuster aperture 56, as illustrated by a comparison of FIGS. 3 and 6. Set screws 154 may also be made longer to accommodate the extra vertical extent to which screws 154 may need to protrude into slot 160. To adjust the height of the axial end of track 16 within slot 160, vertical adjuster screw 176 is advanced into or out of slot 160 until track 16 is at a desired position within slot 160. Next, the tilt of track 16 is adjusted by manipulation of flange bolt 52, as described in detail above with respect to support body 42. Finally, set screws 154 may be tightened into engagement with the top surface of track 16 to fix the height and tilt of track 16.

Height-adjustable support track assembly 130 may be provided at one or both axial ends of tracks 16, as required or desired for a particular application. Lower support body 144 may also be provided with vertical adjustment in a similar fashion to upper support body 142, as shown in FIG. 6, though it is contemplated that support bodies 42, 142 and 44, 144 are interchangeable such that only one of the upper and lower support bodies in assemblies 30 or 130 may be vertically adjustable as required or desired for a particular application.

While this invention has been described as having an exemplary design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A sliding door assembly comprising:

a door;

a support track slideably supporting the door, the support track having axial ends with a longitudinal extent therebetween, and a cross-sectional shape perpendicular to the longitudinal extent, the cross-sectional shape defining a first pivot area and an adjuster engagement area spaced from the first pivot area, the cross-sectional shape having a first substantially parallel wall and a second substantially parallel wall;

a pair of rollers each rotatably coupled to a top portion of the door and rollingly received on the support track, each of the pair of rollers is received on an upper surface of the support track; and a track mounting assembly fixable to an adjacent support surface, the track mounting assembly comprising:

a support body including a track slot sized to receive the support track, the track slot defining a second pivot area adapted to pivotably engage with the first pivot area, the track slot having a first linear wall and a second linear wall; and a tilt adjuster engaging the adjuster engagement area of the support track to selectively adjust a tilt of the support track and hold the support track at a desired tilt angle within the track slot, wherein the desired tilt angle is defined by one of the first linear wall and the second linear wall of the track slot and one of the first substantially parallel wall or the second substantially parallel wall of the support track.

2. The sliding door assembly of claim 1, wherein the track slot is tapered to define a narrow section and a wide section, the narrow section including the second pivot area and the wide section engaging the tilt adjuster.

3. The sliding door assembly of claim 2, wherein the taper of the track mounting assembly is defined between opposed first and second inner walls of the track slot, the opposed first and second inner walls defining an angle of between 0.5 degrees and 3.5 degrees.

4. The sliding door assembly of claim 1, wherein:

the door comprises a curved door with a convex outer surface and a concave inner surface; and the support track comprises a curved support track disposed along the concave inner surface of the door.

5. The sliding door assembly of claim 1, wherein the door comprises a first door, the support track comprises a first support track, and the support body and the tilt adjuster of the track mounting assembly comprise a first support body and a first tilt adjuster respectively, the assembly further comprising:

a second door slideable with respect to the first door;

a second support track slideably supporting the second door; and the track mounting assembly further comprising:

a second support body including a second track slot sized to pivotably receive the second support track; and a second tilt adjuster engaging the second support track to selectively adjust a tilt of the second support track within the second track slot.

6. The sliding door assembly of claim 5, wherein the track mounting assembly further comprises a support anchor coupled to the first support body and the second support body, the support anchor adapted to be fixed to the adjacent support surface and thereby secure the first support body and the second support body relative to the adjacent support surface.

7. The sliding door assembly of claim 6, wherein the first support body and the second support body are each pivotably mounted to the support anchor, whereby the respective track slots can be mounted in a non-perpendicular configuration with respect to the adjacent support surface.

8. The sliding door assembly of claim 7, wherein the first support body is laterally offset with respect to the second support body with respect to a longitudinal axis of the support anchor, such that the first door and the second door are laterally offset with respect to one another when supported by the first and second support tracks respectively.

9. The sliding door assembly of claim 1, wherein-each of the pair of rollers forms a part of a roller assembly, the roller assembly further including a retainer roller rollingly received on a lower surface of the support track.

10. The sliding door assembly of claim 1, wherein the adjuster engagement area of the support track comprises a threaded aperture and the tilt adjuster comprises a flange bolt, the flange bolt received through an aperture formed in the support body and threadably coupled to the threaded aperture with the flange bolt bearing on an outer surface of the support body, such that rotation of the flange bolt effects selective adjustment of the tilt of the support track within the track slot.

11. A sliding door adjustment mechanism comprising:

a support body having a tapered track slot having a cross-section defining a vertical extent and a horizontal extent perpendicular to the vertical extent, the cross-section including a narrow portion defining a pivot area at one vertical end of the tapered track slot and a wide portion defining an adjuster area at an opposing vertical end of the tapered track slot;

a support track of a sliding door having a first end pivotably received within the tapered track slot along the longitudinal axis of the tapered track slot, wherein a first portion of the support track is pivotable about a pivot point in the pivot area of the support body and a second portion of the track is moveable within the adjuster area of the support body, the support track having:

a first angular configuration wherein the support track defines a first angle with respect to an inner wall of the tapered track slot;

a second angular configuration wherein the support track defines a second angle with respect to the inner wall of the tapered track slot, the first angle different from the second angle whereby the support track is angularly adjustable about the pivot point in the tapered track slot; and a support anchor coupled to the support body and adapted to be fixed to an adjacent support surface.

12. The mechanism of claim 11, wherein the support body is removably mounted to the support anchor.

13. The mechanism of claim 12, wherein the support body is pivotably mounted to the support anchor, whereby the tapered track slot can be mounted in a non-perpendicular configuration with respect to the adjacent support surface.

14. The mechanism of claim 11, further comprising a tilt range limiter disposed at a top portion of the support body and operable to selectively axially protrude into the tapered track slot, such that the tilt range limiter is sized and positioned to fix the support track at a desired tilt angle.

15. The mechanism of claim 11, wherein the support body comprises a first support body, the mechanism further comprising:

a second support body coupled to the support anchor, the second support body including a second tapered slot sized to receive a second support track, the second support body laterally offset from the first support body.

16. The mechanism of claim 11, further comprising a door slideably coupled to the support track.

17. The mechanism of claim 11, wherein the support body comprises a first support body, the support track having a second end opposite the first end, the mechanism further comprising:

a second support body having a second tapered track slot having a cross-section defining a vertical extent and a horizontal extent perpendicular to the vertical extent, the cross-section of the second support body including a narrow portion defining a pivot area at one vertical end of the tapered track slot and a wide portion defining an adjuster area at an opposing vertical end of the tapered track slot, the second end pivotably received within the tapered slot of the second support body, wherein a first portion of the second end is pivotable about a pivot point in the pivot area of the second support body and a second portion of the second end is moveable within the adjuster area of the second support body.

* * * * *